United States Patent [19]

Ditcher

[11] Patent Number: 4,566,483

[45] Date of Patent: Jan. 28, 1986

[54] DROP MANHOLE PRECAST ENCASEMENT

[75] Inventor: Jack Ditcher, Langhorne, Pa.

[73] Assignee: A-Lok Products, Inc., Tullytown, Pa.

[21] Appl. No.: 660,650

[22] Filed: Oct. 15, 1984

[51] Int. Cl.[4] ..... E02D 29/12

[52] U.S. Cl. ..... 137/372; 137/363; 52/20; 52/21

[58] Field of Search ..... 137/363, 372; 52/20, 52/21

[56] References Cited

U.S. PATENT DOCUMENTS

| | | | |
|---|---|---|---|
| 1,582,191 | 4/1926 | Snooke | 137/363 |
| 3,212,519 | 10/1965 | Paschen | 137/363 |
| 3,562,969 | 2/1971 | Little, Jr. | 137/363 |
| 3,695,153 | 10/1972 | Dorris | 52/21 |
| 4,023,590 | 5/1977 | Harris et al. | 137/363 |
| 4,337,005 | 6/1982 | LeBaron | 52/20 |
| 4,341,236 | 7/1982 | La Benz | 137/363 |
| 4,472,911 | 9/1984 | Jooris et al. | 52/20 |

OTHER PUBLICATIONS

"International Pipes' Geromics Corp", East Orange, N.J., Engineering News Record, 11/62, p. 12.

*Primary Examiner*—A. Michael Chambers
*Attorney, Agent, or Firm*—Louis Weinstein

[57] ABSTRACT

A system of modular precast encasement sections is provided to protect the outside drop of a manhole structure from damage due to weak ground support and to prevent leakage from said outside drop. Said precast encasement sections are stacked on top of a drop manhole base and on top of each other to a height sufficient to surround and support the outside drop tube. The stack of encasement sections is then capped off with a solid collar which has a circular opening of a diameter sufficient to receive the outside drop tube. This circular opening widens to form a shoulder which is adapted to receive and support thereon the lower most opening of a T-coupler for joining a supply line to the drop tube. The precast encasement sections, the solid collar, and the face of the manhole base which is to receive the stack of encasement sections are each provided with grooves on their upper faces and the solid collar and encasement sections are provided with coaligned projections along their lower faces. These grooves and projections serve to automatically align the sections with the manhole base, with the solid collar and with each other when the sections are assembled on site.

14 Claims, 7 Drawing Figures

DROP MANHOLE PRECAST ENCASEMENT

BACKGROUND OF THE INVENTION

This invention relates to a new and useful improvement in precast manhole constructions of the drop manhole type.

A common type of manhole construction employs a base, a riser section and a tapered top section for supporting a cover frame which receives a removable manhole cover. The top section has an opening near the lower end thereof communicating with a pipe. The base has openings for connection to service lines.

The depth at which the service line is embedded in the ground determines the height of the inlet. Since service lines are generally buried only to the depth required in order to minimize excavation, the inlet is well above the manhole base in many installations. In order to protect workmen entering the manhole from fluid entering through the elevated inlet, it is customary to dam off a portion of the inlet and to install an outside drop. Such an outside drop employs a T-connection outside of the manhole assembly wherein one portion of the T is connected to the service line, a second portion of the T is connected to the inlet in the manhole, and a third portion of the T extends downwardly for connection to suitable outside conduit means encased in concrete and having an elbow directed into the manhole base adjacent to the bottom of the latter.

These outside drops have the disadvantage that they add considerable expense to the manhole construction, especially due to the fact that the drop assembly must be constructed at the job site. In addition, in the event of poor ground support and other factors, breaking of the encasing concrete and shearing of the conduit often takes place and leakage thus occurs.

SUMMARY OF THE INVENTION

It is therefore a primary object of the present invention to provide a precast drop manhole encasement which overcomes the disadvantages of existing drop manhole constructions and is quite easy to install and requires no fabrication of components at the job site.

A more particular object of the present invention is to provide a drop manhole encasement comprised of precast components which surround the outside drop in order to protect and support the drop and prevent leakage.

Another object of the present invention is to provide a precast drop manhole encasement comprised of modular U-shaped sections which, being precast, may be quickly assembled in situ, thereby saving considerable time and expense at the construction site.

Still another object is to provide a precast drop manhole encasement formed of modular sections of varying heights which may be assembled one on top of the other to the exact height of any particular drop to eliminate custom fitting at the job site.

Still another object of the present invention is to provide a precast drop manhole encasement with modular encasement sections haveing interfitting means to automatically align the sections to provide and ensure a stable and rigid structure, alleviating the need for bonding agents between the sections.

Still another object of the present invention is to provide a precast drop manhole encasement comprised of modular sections formed at the factory and which are easily stored, transported and installed on-site.

BRIEF DESCRIPTION OF THE DRAWINGS

The above and other objects of the present invention will become apparent from the following description taken in connection with the accompanying drawings, in which.

According to the present invention, a precast drop manhole encasement is provided to surround and protect outside drops. The encasement comprises a protective U-shaped collar formed of modular stacking units each having integral alignment means provided to facilitate stacking of the modular units in perfect alignment and to give the structure the rigidity of an integrated whole.

Figure 1:
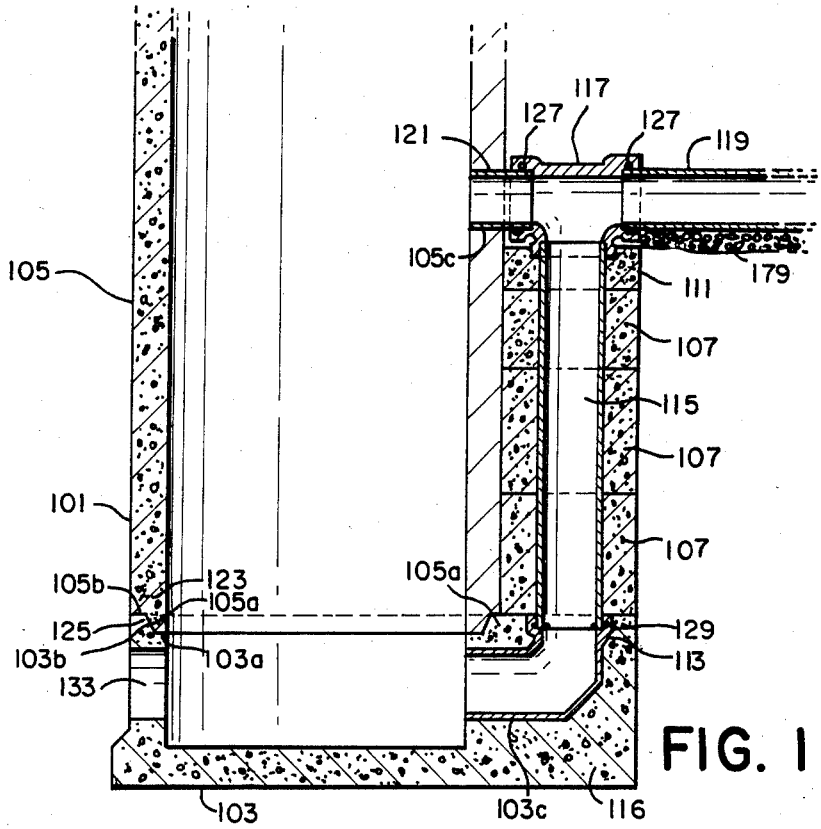
FIG. 1 is a vertical cross-section of a drop manhole construction illustrating the use of the present invention.

Referring to FIG. 1, a drop manhole 101 incorporating the precast modular encasement sections of the present invention is illustrated. The manhole construction 101 includes a base 103 generally constructed of reinforced concrete and which is preferably precast but may be poured in an excavation at the job site. A cylindrical riser section 105 rests upon base 103. Riser section 105 is supported on base 103 and interfits with the base in the manner shown at 123. The inner annular projection 105*a* rests on inner annular shoulder 103*a*. The outer annular shoulder 105*b* rests on outer annular projection 103*b*.

A service line 119 is joined to the right hand end of a T-section 117. The left hand end of T-section 117 is joined to pipe section 121 extending through the opening 105*c* in riser 105. The bottom opening in T-section 117 receives the upper end of vertical pipe 115. Gaskets 127 provide water-tight seals between section 117 and pipes 119, 121 and 115.

Pipe 115 communicates with the upper end of an elbow pipe section 113. The left-hand end of elbow section 113 extends into opening 103*c* in base 103. Gasket 129 provides a water-tight seal between elbow section 113 and pipe 115. The elbow section 113 is cast in a concrete support 116 forming an integral part of base 103.

Effluent flowing through service line 119 will normally flow into outside drop 115 and through elbow tube 113 into the interior of base 103, and exit the manhole through a pipe (not shown) typically extending into opening 133 and omitted for purposes of simplicity. The manhole enables service line 119 and the outlet line coupled to outlet opening 133 to be serviced by workmen entering the manhole.

The present invention resides in the provision of precast encasement sections 107 stacked first on support 116 of the manhole base 103 and then on top of each other to a predetermined height so as to surround, support and protect pipe 115 and support the bottom end of T-connection 117. Modular sections 107 serve to protect the pipe 115 comprising the outside drop from stress and from being crushed or broken.

The modular sections 107 are preferably precast in varying heights so that they may be combined to accomodate drops of varying heights. In one particular embodiment already practiced, precast sections 107 have been produced with heights of 12, 24 and 36 inches. The sections 107 are provided with alignment means in the form of coaligned V-grooves and cooperating V-projections of adjacent sections which cooperate to facilitate perfect alignment and which retain the sections 107 in the assembled state once they are assembled. These coaligned grooves and projections further serve to prevent dislodging of the stacked sections with respect to each other due to shifting ground conditions.

Figure 2:
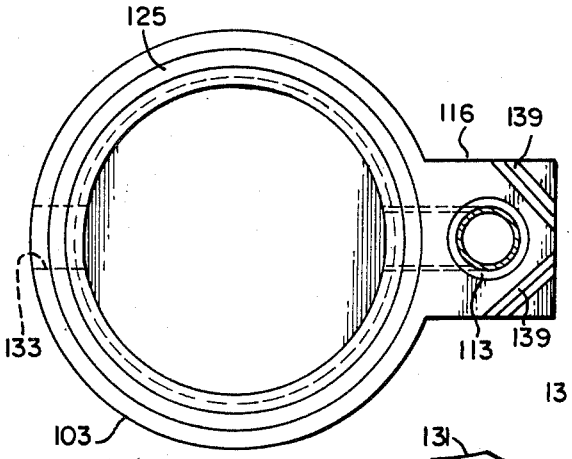
FIG. 2 is a top plan view of the drop manhole base employed in the manhole of FIG. 1.
Figure 4:
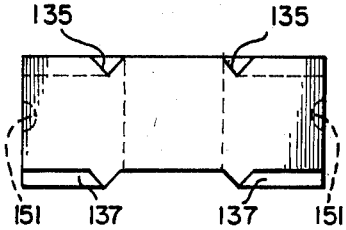
FIG. 4 is a side elevational view of the modular section shown in FIG. 3 as seen from the line of sight along arrows 4—4 of FIG. 3.
Figure 3:
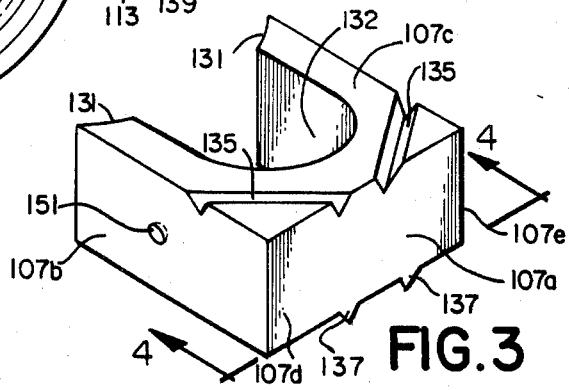
FIG. 3 is a perspective view of a modular encasement section according to the present invention and showing the top, left and front sides of the collar.

One typical precast encasement section 107 is illustrated in FIG. 3. The section 107 consists of a precast U-shaped member having a yoke portion 107*a* and integral arms 107*b*, 107*c*. Section 107 is positioned to surround outside drop tube 115. Curved ends 131 of arms 107*b*, 107*c* conform to the shape of the outer periphery of riser 105 and engage the outer surface of riser 105 so that drop tube 115 is completely enclosed between the exterior surface of riser 105 and the interior 132 of the encasement sections 107. Each precast encasement section 107 is further provided with a series of projections and grooves to ensure perfect alignment when the sections 107 are stacked on top of each other. The top horizontal face of each section 107 is provided with two diagonally aligned V-shaped grooves 135, 135 positioned between each corner 107*d*, 107*e* and the curved interior surface of U-shaped section 107 and arranged substantially at a right angle relative to one another. The bottom horizontal face is provided with diagonally aligned V-shaped projections 137, 137 also arranged between corners 107*d*, 107*e* and the interior U-shaped periphery of section 107 and arranged at a right angle relative to one another. As may be seen in FIGS. 4 and 5, grooves 135 and projections 137 are aligned precisely so as to lie in common vertical planes to perfectly align each section 107 with the section 107 below it when the projections 137 of the upper section engage the grooves 135 of the lower section. Similarly, alignment of encasement sections 107 with manhole base 103 is ensured by the provision of diagonally aligned V-shaped grooves 139 provided in the top of cast section 116 and arranged on opposite sides of elbow pipe 113. Grooves 139 may best be seen in FIGS. 2 and 5.

Figures 4A, 5, 6:
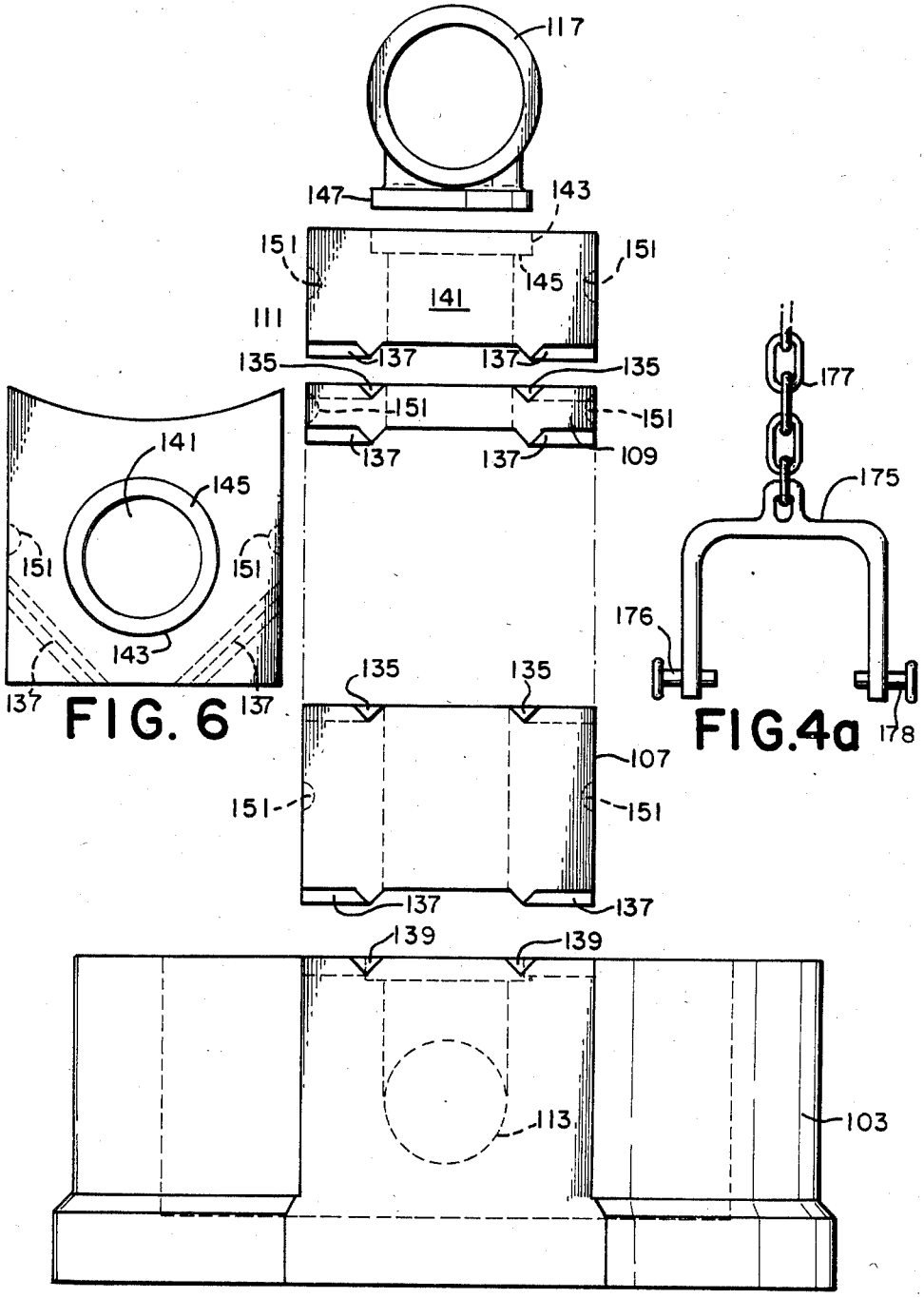
FIG. 4*a* shows the lifting assembly for lifting the sections shown in FIG. 3.
FIG. 5 is an exploded side elevational view showing the base unit of FIG. 2 and several of the modular collar units of FIG. 4 in a stacked configuration.
FIG. 6 is a top plan view of the top collar section of FIG. 1.

Each modular encasement section 107 is provided with a pair of lift inserts 151 in arms 107*b*, 107*c* for lifting the encasement section 107 by means of assembly 175 coupled to chain 177 (see FIG. 4*a*). The reciprocating pins 176, 178 are moved into lift inserts 151, 151 to lift section 107 and are removed from inserts 151, 151 when the section 107 is placed either on a section beneath section 107 or upon support 116.

A solid collar 111 is placed on top of the stack of precast encasement sections to finish off the encasement assembly. As seen in FIG. 1, the opening 141 in collar 111 completely surrounds and engages drop tube 115 and the bottom outlet of T-coupler 117. FIG. 5 shows the rear face of solid collar 111 which is placed on top of the stacked precast encasement sections 109. Solid collar 111 is provided with V-shaped projections 137 on its bottom horizontal surface which interfit with V-shaped grooves 135 in the top surface of encasement section 109. The grooves 135 ensure the perfect alignment of collar 111 with the rest of the precast encasement sections 107 below. The inner diameter of opening 141 in solid collar 111 is substantially identical to the diameter 145 of the inner circular shaped periphery of each of the precast encasement sections 107. Solid collar 111 is further provided with an annular opening 143 at its upper end which is larger than opening 141 and is joined thereto by shoulder 145. This is best shown in FIGS. 5 and 6. As seen in FIG. 5, opening 143 is slightly larger than the outer diameter of the bottom 147 of T-coupler 117. Once assembled, the flange 147 of T-coupler 117 rests on shoulder 145, thereby providing structural support for T-connector 117 and relieving drop 115 of these downward forces.

The solid collar 111, as shown best in FIG. 6, is provided with acurved surface 149 having a radius of curvature substantially the same as the radius of curvature of the outer periphery of riser section 105, and is mated therewith when collar 111 is installed.

The design of the encasement sections 107 permit them to be assembled without the need for cement or caulking. The mating of the aligning grooves 135 and projections 137 provides the necessary retaining forces between adjacent section. Their right angle orientation facilitates initial alignment and prevents relative linear movement and/or rotational movement between adjacent sections 117.

Assembly of the drop manhole is quite simple and includes the following steps: The lower end of drop pipe 115 is inserted into the upper end of elbow section 113. The sections 107 are placed, one upon the other with the projections of an upper section interfitting into the grooves of a lower section. Sections of varying heights may be used to obtain the desired overall height. The solid collar 111 is placed upon the top most section 107'. The T-connection 117 is placed upon solid collar 111 and joined to pipe sections 121 and 115. A stone bedding 179 is provided to support service pipe 119, which pipe is placed upon the stone bedding and is inserted into the right-hand end 127 of T-connection 117. The grooves 135 and the projections 137 are perpendicular to one another to prevent any sliding movement of each section 107 relative to its adjacent section.

It is to be understood that the forms of this invention herein shown and described are to be taken as preferred examples of the same and that various changes in the shape, size and arrangements of the parts may be resorted to without departing from the spirit of the invention or the scope of the subjoined claims. For example, the system of projections 137 and grooves 135 for automatically aligning the precast encasement sections may be replaced by pins and sockets, or by hemispherical or curved projections and depressions arranged along the imginary diagonal lines occupied by grooves 135 and projections 135. Also, the number and position of the various aligning means may be varied to suit the individual application. It is further to be understood that the concept of providing precast encasement sections to surround outside drops may be applied to existing manhole structures.

It will be understood, therefore, that the invention is not to be limited to the embodiment described above and it is contemplated, by the appended claims, to cover any such modifications as fall within the true spirit and scope of this invention.

What is claimed is:

1. A supporting assembly of precast modular sections for use in surrounding and supporting the vertical pipe section in a drop manhole assembly, said vertical pipe section extending between the base of the drop manhole assembly and a supply conduit external to said manhole assembly and along the exterior of the drop manhole assembly for delivering effluent to the interior of said drop manhole assembly base, said supporting assembly comprising:

a plurality of precast modular sections arranged to be stacked one upon the other along the exterior of the manhole assembly;

each of said sections having a substantially U-shaped configuration and having mating means along the upper and lower surfaces thereof wherein the mating means of the lower surface of each section engages and interfits with the mating means of the upper surface of the adjacent section, said mating means cooperating to facilitate initial alignment between stacked sections and prevent the stacked sections from being laterally slidably separated from one another.

2. The supporting assembly of claim 1 wherein the drop manhole assembly includes a riser section arranged upon the manhole base, the free ends of said U-shaped modular sections engaging the outer periphery of the riser section and cooperating with the riser section to completely surround said vertical pipe section.

3. The supporting assembly of claim 1 further comprising a hollow coupling section for coupling the supply conduit to the vertical pipe section;

said support section further comprising a top collar section arranged upon the top-most modular section and having mating means along the bottom surface thereof engaging the mating means along the top surface of the adjacent modular section to prevent slidable movement therebetween;

said collar section having an opening for positioning and supporting said hollow coupling section.

4. The supporting assembly of claim 1 where each of said modular sections have a U-shaped configuration defined by a yoke portion and first and second integral arms;

said top and bottom surfaces being substantially planar;

one of said surfaces having a pair of projections aligned diagonally relative to one another;

the remaining one of said surfaces having a pair of grooves aligned diagonally relative to one another;

each of said projections lying in a common vertical plane with an associated one of said grooves to facilitate alignment and interengagement of the grooves of one modular section with the projections of an adjacent engaging modular section.

5. The supporting assembly of claim 4 wherein said projections and said grooves have a substantially V-shaped cross-sectional configuration.

6. The supporting assembly of claim 5 wherein the free ends of the arms of each modular section are curved and have a radius of curvature which substantially conforms to and engages the outer periphery of the manhole riser section.

7. The supporting assembly of claim 5 further comprising a solid collar section including means along the bottom surface thereof for interlocking with the engaging mating means of the next adjacent modular section;

one side surface of said solid collar section being curved and having a curvature substantially conforming to the outer periphery of said manhole riser section and engaging said outer periphery when positioned on the adjacent modular section.

8. The supporting assembly of claim 7 wherein the opening in said solid collar positions and supports said vertical pipe section and wherein the top end of said opening is provided with an enlarged diameter portion for receiving the end of the coupling section joined to the upper end of the vertical pipe section.

9. The supporting assembly of claim 1 wherein all of said modular sections are of uniform height.

10. The supporting assembly of claim 1 wherein the modular sections are of varying heights.

11. The supporting assembly of claim 1 wherein at least one of the modular sections is of a first height, at least another one of the modular sections is of a second height, and at least still another one of the modular sections is of a third height, said first, second and third heights being different from one another.

12. The supporting assembly of claim 11 wherein the second height is double the first height and the third height is triple the first height.

13. The supporting assembly of claim 1 wherein said modular sections comprise a yoke portion and integral arms extending from the yoke portion and defining the U-shaped configuration, said arms each having an opening along the external surfaces thereof for receiving pins to facilitate lifting of said modular sections.

14. The supporting assembly of claim 9 wherein the height of a modular section is substantially less than the height of the sections forming the manhole assembly.

* * * * *

UNITED STATES PATENT AND TRADEMARK OFFICE

CERTIFICATE OF CORRECTION

PATENT NO. : 4,566,483

DATED : January 28, 1986

INVENTOR(S) : JACK DITCHER

It is certified that error appears in the above-identified patent and that said Letters Patent is hereby corrected as shown below:

Column 6, lines 18 and 19, delete "engaging".

Signed and Sealed this

*Twenty-sixth* Day of *August 1986*

[SEAL]

*Attest:*

DONALD J. QUIGG

*Attesting Officer*

*Commissioner of Patents and Trademarks*